United States Patent [19]

Chappell

[11] Patent Number: 4,895,468

[45] Date of Patent: Jan. 23, 1990

[54] BRUSH WITH AUTOMATIC WATER SHUT-OFF

[76] Inventor: Gilmore H. Chappell, 6100 City Ave., Executive House, Apt. 1718, Philadelphia, Pa. 19131

[21] Appl. No.: 263,958

[22] Filed: Oct. 26, 1988

Related U.S. Application Data

[63] Continuation of Ser. No. 45,323, May 4, 1987, abandoned.

[51] Int. Cl.[4] ..... A46B 11/00; A46B 11/02; A46B 11/06

[52] U.S. Cl. ..... 401/270; 401/42; 401/272; 401/274; 401/275; 401/278; 401/279; 401/289

[58] Field of Search ..... 401/270, 272, 273, 274, 401/275, 278, 279, 42, 43, 289

[56] References Cited

U.S. PATENT DOCUMENTS

| | | | |
|---|---|---|---|
| Re. 30,849 | 1/1982 | Crist . | |
| 656,759 | 8/1900 | Wirt . | |
| 665,631 | 1/1901 | Duffus . | |
| 703,103 | 6/1902 | Weber . | |
| 1,181,594 | 5/1916 | Hinkle . | |
| 1,244,833 | 10/1917 | Burich . | |
| 1,372,125 | 3/1921 | Dreier . | |
| 1,510,898 | 10/1924 | Nikicser . | |
| 1,970,279 | 8/1934 | Creveling . | |
| 2,037,023 | 4/1936 | Holby . | |
| 2,133,147 | 10/1938 | Mortimore . | |
| 2,164,432 | 7/1939 | Selwyn | 401/273 |
| 2,234,386 | 3/1941 | Schaub et al. . | |
| 2,254,069 | 8/1941 | Harris . | |
| 2,441,704 | 5/1948 | Jackson . | |
| 2,456,687 | 12/1948 | Dominguez . | |
| 2,512,281 | 6/1950 | Lofstrand, Jr. . | |
| 2,525,615 | 10/1950 | Peck . | |
| 2,584,631 | 2/1952 | Soss | 401/279 X |
| 2,683,886 | 7/1954 | Neumann . | |
| 2,797,132 | 6/1957 | Alpert | 401/43 X |
| 2,802,481 | 8/1957 | Jahn . | |
| 2,830,614 | 4/1958 | Pralle . | |
| 2,877,480 | 3/1959 | Warren . | |
| 2,922,425 | 1/1960 | Lerner et al. . | |
| 2,997,732 | 8/1961 | Gilchrist et al. . | |
| 3,016,605 | 1/1962 | Heckethorn . | |
| 3,107,861 | 10/1963 | Penkoff . | |
| 3,145,724 | 8/1964 | Pelzer . | |
| 3,273,757 | 9/1966 | Moen | 401/273 X |
| 3,357,604 | 12/1967 | Barker . | |

(List continued on next page.)

FOREIGN PATENT DOCUMENTS

| | | | |
|---|---|---|---|
| 519342 | 12/1955 | Canada | 401/272 |
| 813149 | 9/1951 | Fed. Rep. of Germany | 401/279 |
| 927621 | 5/1955 | Fed. Rep. of Germany | 401/289 |
| 2153439 | 5/1972 | Fed. Rep. of Germany | 401/272 |
| 2203968 | 8/1972 | Fed. Rep. of Germany . | |
| 852547 | 10/1939 | France | 401/289 |
| 1239099 | 10/1959 | France . | |
| 566018 | 8/1957 | Italy . | |
| 6500078 | 1/1966 | Netherlands | 401/272 |

*Primary Examiner*—Steven A. Bratlie
*Attorney, Agent, or Firm*—Christie, Parker & Hale

[57] ABSTRACT

A brush with automatic water shut-off is disclosed. The brush includes a handle portion pivotally connected to a body portion with a valve chamber intermediate to control water flow through the brush. A flutter valve is loosely positioned within the valve chamber and is continuously biased toward the valve chamber seat by the water pressure. An operating rod is movable within the body portion and extends past the plane of the seat. When the brush is not in use, water pressure forces the flutter valve toward the seat and contact between the flutter valve and the operating rod causes the body portion and handle portion to be pivotally offset with no water flowing. When the brush bristles contact the surface to be cleaned, the body and brush portions are urged into axial alignment about the pivot whereby the operating rod will force the flutter valve off of its seat, thereby automatically causing water flow through the brush. In one embodiment, axial movement of the operating rod is controlled by an external lever to vary the position of the operating rod relative to the seat to thereby adjust the volume of flow.

20 Claims, 4 Drawing Sheets

U.S. PATENT DOCUMENTS 3,476,105 11/1969 Abramowitz .
3,552,870 1/1971 Brooks .
3,618,629 11/1971 Heyer et al. .
3,642,181 2/1972 Thomas et al. .
3,669,138 6/1972 Schoepe et al. .
3,670,760 6/1972 Butcher et al. .
3,748,678 7/1973 Ballow .
3,888,461 6/1975 Bron .
3,943,591 3/1976 Lanusse .
3,989,391 11/1976 Thorner .
4,175,300 11/1979 McGlew et al. .
4,217,059 8/1980 Shelton ..... 401/270 X
4,236,840 12/1980 Kennedy ..... 401/270 X
4,407,213 10/1983 Evans .
4,532,666 8/1985 Smyth .

BRUSH WITH AUTOMATIC WATER SHUT-OFF

CROSS REFERENCE TO RELATED APPLICATIONS

This is a continuation of application Ser. No. 07/045,323, filed May 4, 1987 now abandoned.

BACKGROUND OF THE INVENTION

1. Field of the Invention

The present invention relates generally to the field of brushes, and more particularly, is directed to a brush adapted to be connected to a conventional garden hose and which is provided with an automatic water shut-off valve.

2. Description of the Prior Art

It is known to employ various types of brushes which are adaptable for connection to a source of water under pressure, for example a conventional garden hose. Such brushes include bristles suitable for cleaning polished surfaces without scratching, such as, the painted and polished surfaces of motor vehicles and similar flat or curved surfaces which may be conveniently cleaned using water.

Numerous types of car cleaning brushes have been developed by prior workers in the art and some such brushes, for example, the brush disclosed in U.S. Pat. No. 4,532,666 include a turbine type of construction wherein at least a portion of the brush will be rotated by the water under pressure as it passes through the brush.

While the prior art types of water carrying brushes have generally proved to be effective in use, one common drawback is the fact that such brushes have been operated without any convenient method for shutting off the water supply other than by turning a faucet handle at the hose connection to the building water supply. Because of this, it was usually somewhat inconvenient to first turn on a remote water supply to apply water under pressure at the brush for cleaning purposes. Following the application of the brush and its water supply upon the surface to be cleaned, it was then necessary to go back to the remote faucet to turn off the water supply prior to drying the vehicle or other surface.

Despite the variety of prior art water equipped brushes that have been developed to date, the need remains to provide a brush having suitable valve means within the brush itself to permit control of the flow of water directly at the cleaning site.

SUMMARY OF THE INVENTION

The present invention relates generally to the field of brushes suitable for use with hose connected water supplies, and more particularly, is directed to a brush construction including an integral automatic water shut-off valve. In accordance with the present invention, the operator can easily apply the brush and water to the surface to be cleaned and wherein the shut-off will function automatically to stop the flow of water when the brush is removed from the surface being cleaned.

The brush of the present invention includes a handle portion and a body portion having a water conduit therethrough wherein the water under pressure is directed through the bristles for direct application upon a surface to be cleaned. In the preferred embodiment, the brush body is provided with a detergent reservoir to facilitate the easy application of a detergent or liquid soap directly to the surface as the surface is being cleaned by the brush.

The handle portion connects to the body portion in a pivotal interconnection and is provided with conventional threads for connection to one end of a conventional garden hose. The handle portion includes an axial water conduit therethrough and a valve chamber near the connection to the body portion. A flutter valve is freely movable within the chamber and is biased against a seat by the water under pressure to normally prevent water from flowing from the handle portion through the body portion.

An operating rod is axially positioned within the body portion and is axially movable toward and away from the seat of the handle portion. The inward end of the operating rod will normally extend into the valve chamber and rearwardly beyond the plane of the valve seat. When the brush is not in use, the water under pressure will normally force the flutter valve toward its seat and toward the inward end of the rod. Upon contacting the inward end of the operating rod, the flutter valve under pressure will cause the handle portion to pivot relative to the body portion until the flutter valve can rest upon and seal against the seat. Once the valve is seated, there will be no tendency for the handle portion to angularly pivot any further. It is noteworthy that the pressure of the water continuosly forces the flutter valve toward its seat to normally act as a shut-off to prevent water from flowing through the brush. When the brush is applied against a surface to be cleaned, the forces urging the brush against the surface will overcome the water pressure forces of the flutter valve against the end of the operating rod to cause the parts to pivot into axial alignment, thereby causing the operating rod to force the flutter valve from its seat. With the parts so arranged, the internal brush valve will then be open and water will flow freely from the hose, through the conduit in the handle portion, through the flutter valve and then through the interior conduit of the body portion.

In a preferred embodiment, an adjusting block is slidable within the interior cavity of the body portion in a manner to permit movement of the operating rod toward or away from the flutter valve. An adjusting lever extends from the block and is movable within a cam slot provided in the body portion to axially move the operating rod through an infinite number axially adjusted positions. Accordingly, by employing the adjusting lever, it is easily possible to adjust the quantity of water flow through the device when the brush is in use.

A detergent reservoir is preferably provided in the body portion above the bristles and includes an easily replaceable cap to facilitate the application of a liquid cleanser therewithin. In a preferred embodiment, the detergent reservior is subdivided by an internal weir into a storage compartment and an application compartment. A measured quantity of liquid detergent can be urged over the weir by simply tilting the brush. In this manner, a small quantity of detergent can then be applied from the application compartment through a discharge orifice which is especially designed to allow gravity flow of a quantity of detergent to the surface being cleaned while the brush is being used. When the amount of detergent in the application compartment is exhausted, additional quantities of detergent can be added by again forwardly tilting the brush to allow a portion of the stored detergent to flow over the weir from the reservoir compartment into the application compartment.

It is therefore an object of the present invention to provide an improved brush with water shut-off of the type set forth.

It is another object of the present invention to provide a novel brush with water shut-off which comprises a handle portion having an endward hose connection thereon, the handle portion being provided with an axial water conduit, the water conduit terminating inwardly in a valve chamber and a body portion pivotally connected to the handle portion, the body portion including a water conduit to receive water from the handle portion, the brush being provided with a flutter valve in the valve chamber to normally prevent water flow therethrough, and means to open the valve automatically when the brush is applied to a surface to be cleaned.

It is another object of the present invention to provide a novel brush with water shut-off comprising handle means for directing water flow therethrough, body means connected to the handle means to receive water from the handle means, the body portion having a surface cleaning brush secured thereon, valve means to normally prevent the flow of water from the handle means through the body means and operating rod means to open the valve means when the brush of the body portion is applied against a surface to be cleaned.

It is another object of the present invention to provide a novel brush with water shut-off which includes a handle portion and a brush portion pivotally connected together, the handle portion and brush portion having a water conduit therethrough, a normally closed valve intermediate the handle portion and the brush portion to normally interrupt the flow of water through the brush and valve operating means axially movable through the brush portion, the valve operating means being adapted to open the valve means when the brush portion is applied against a surface to be cleaned.

It is another object of the present invention to provide a novel brush with water shut-off that is rugged in construction, automatic in operation and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DETAILED DESCRIPTION OF THE PREFERRED EMBODIMENTS

Figure 1:
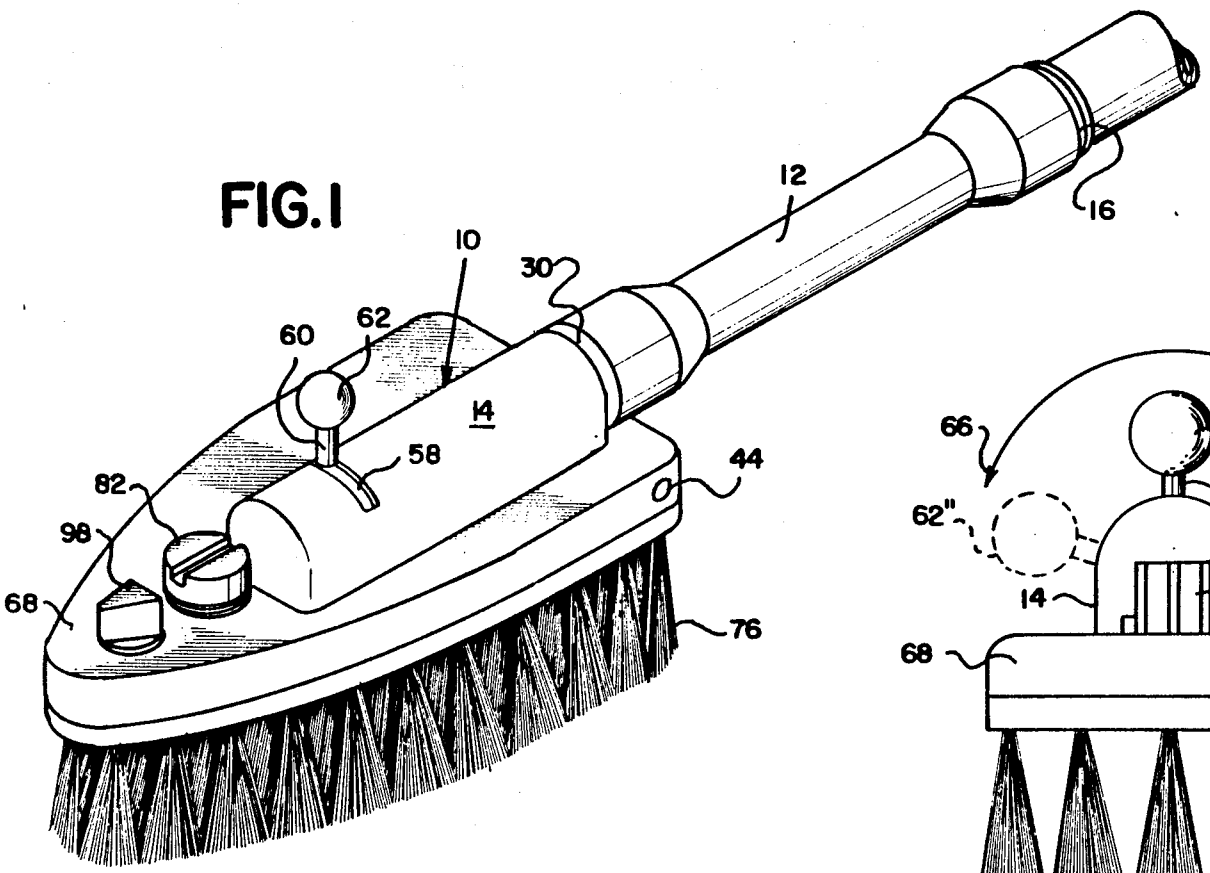
FIG. 1 is a perspective view of a brush with a water shut-off valve in accordance with the present invention.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIG. 1 a novel brush 10 which comprises generally a handle portion 12 and a pivotally interconnected body or brush portion 14. The handle portion 12 terminates rearwardly in a threaded socket 16 which is suitable for connection to the threaded end of a usual garden hose (not shown) in conventional manner.

Figure 3:
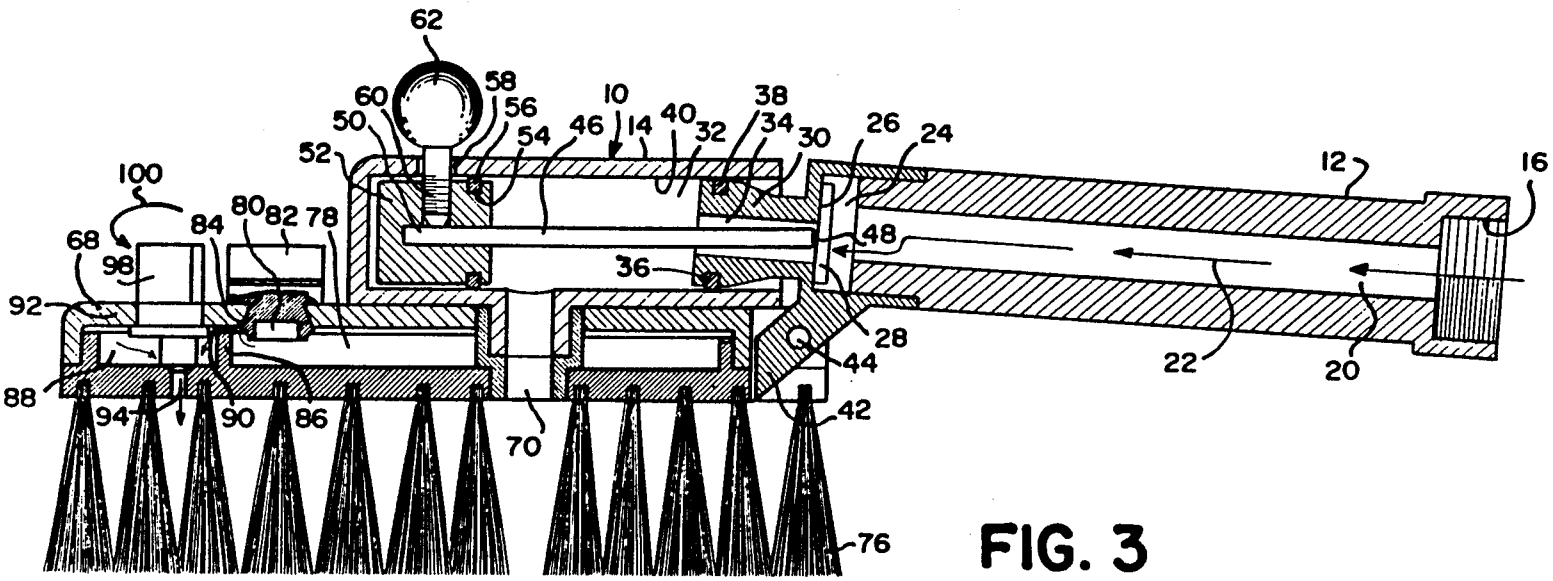
FIG. 3 is a cross sectional view from the perspective of section line 4—4 on FIG. 5, looking in the direction of the drawings and showing the valve in its normally closed position.
Figure 4:
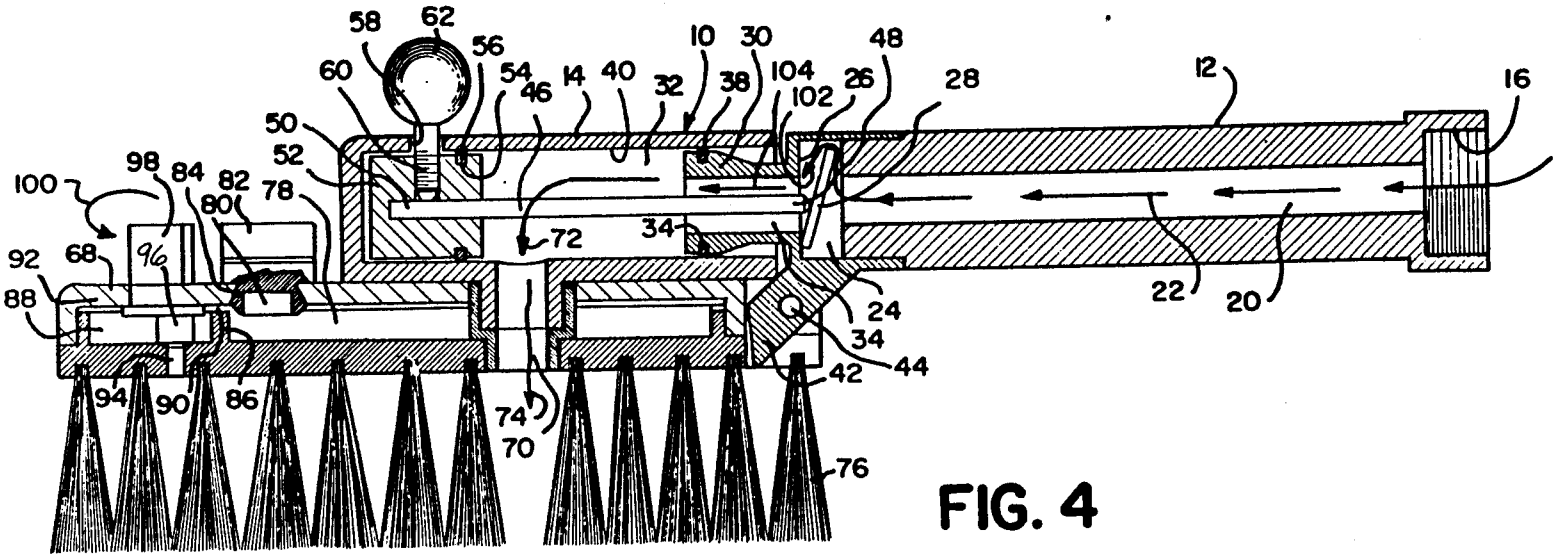
FIG. 4 is a cross sectional view similar to FIG. 3, showing the arrangement of parts with the valve open.

As best seen in FIGS. 3 and 4, the handle portion 12 is provided with an axial water conduit 20 to permit water flow therethrough in the direction indicated by the arrow 22. The conduit 20 extends from the threaded socket 16 and terminates forwardly in open valve chamber 24, which chamber is intended to normally be filled with water under all conditions of use. The valve chamber terminates forwardly in a flat seat 26 of size and configuration to receive thereon a flutter valve 28 in sealing engagement. Preferably, the flutter valve is not connected within the valve chamber and is free to move therein between seated and unseated positions to control the flow of water through the brush. As illustrated in FIG. 3, when the brush 10 is not in use, water under pressure will impinge upon the loose flutter valve 28 and will force the valve through the valve chamber 24 until it presses upon and seals against the valve seat 26. When the flutter valve 28 is pressed against the seat 26, water flow through the brush 10 will be interrupted and this construction will function as an automatic shut-off, without requiring any attention on the part of the user.

Still referring to FIGS. 3 and 4, the forward end 18 of the handle portion 12 is integrally formed with an extending nozzle 30 which projects interiorly of the brush portion 14. As shown, the brush portion 12 includes a cooperating, hollow conduit 32 to receive water under pressure from the handle portion 12. The handle portion nozzle 30 includes an interior water conveying bore or conduit 34, which conduit intercommunicates between the valve chamber 24 and the brush portion bore 32. As shown, the nozzle 30 is formed with a peripheral groove 36 to receive therein a rubber O-ring seal 38 or other suitable elastomeric type of sealing construction. The O-ring seal 38 bears against the inner periphery 40 of the brush portion conduit 32 to prevent any backflow or loss of water at the interconnection between the handle portion 12 and the brush portion 14 under all pivoted positions of use.

A pair of connecting lugs 42 forwardly project from the handle portion 12 below the nozzle 30 and into recesses provided in the body 68 of the body portion 14. A pivot pin 44 extends through the body 68 and the lugs 42 to allow limited pivotal movement between the handle portion 12 and the brush portion 14. As illustrated in FIG. 3, when the brush 10 is in its initial, unsed condition, the handle portion 12 is normally angularly cocked relative to the brush portion 14 about the pivot pin 44. As previously set forth, the angularity is produced by end of the valve operating rod 46 contacting the flutter valve 28. With the parts angularly cocked as shown in FIG. 3, the valve seat 26 will be pivoted away from the rear of the operating rod 46 whereby the flutter valve 28 will be free to seal against the valve seat 26 under the impetus of the water pressure.

Still referring to FIGS. 3 and 4, it will be seen that the valve operating rod 46 is axially moveable through the body portion water conduit 32. The operating rod may be fabricated of metal or hard plastic and is normally positioned so that its valve contact end 48 extends rearwardly beyond the seat 26 when parts are axially aligned as in FIG. 5. This forces the flutter valve 28 away from the seat 26, thereby allowing water to freely flow through the brush. The forward end 50 of the valve operating rod 46 is encapsulated within a plastic or other suitable material slide block 52 in a non-releaseable interconnection, for example, by employing a suitable cement or by a friction fit. The slide block 52 is designed and configured to have limited axial movement within the interior of the brush portion hollow conduit 32. As shown, the slide block is provided with a peripheral groove 54 of known construction and dimensions to receive and secure therein a suitable sealing element, for example, a conventional O-ring gasket 56. The gasket 56 seals the slide block 52 against the interior periphery 40 of the conduit 32 to prevent water leakage thereabout under all conditions and positions of use the slide block 52.

Figure 2:
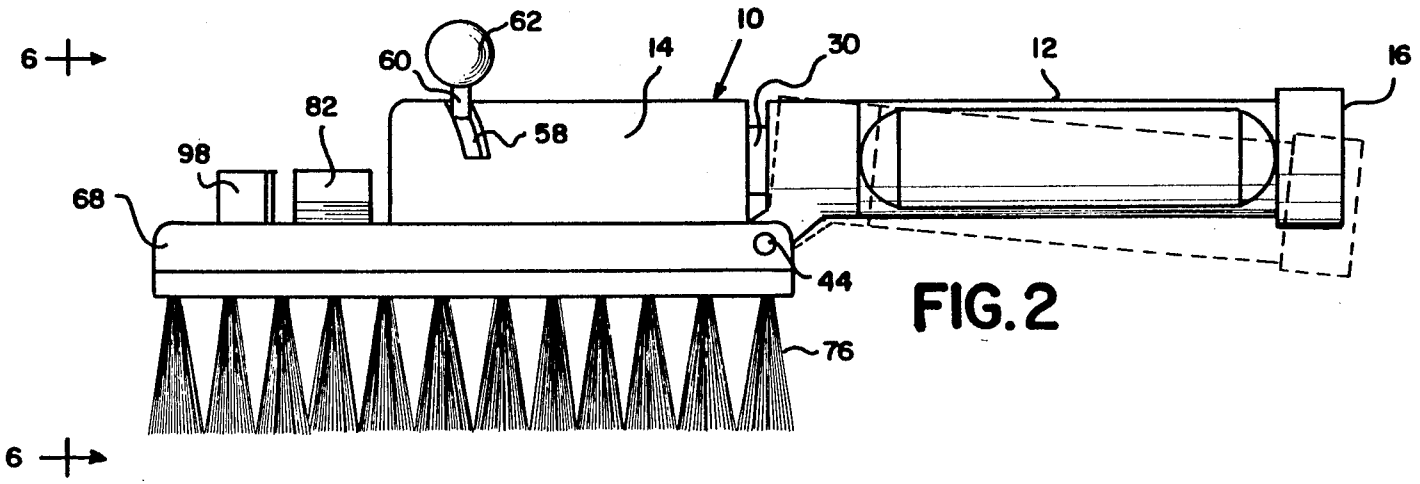
FIG. 2 is a side elevational view of the brush showing the parts in full lines in operating position and in broken lines in the water shut-off position.
Figure 5:
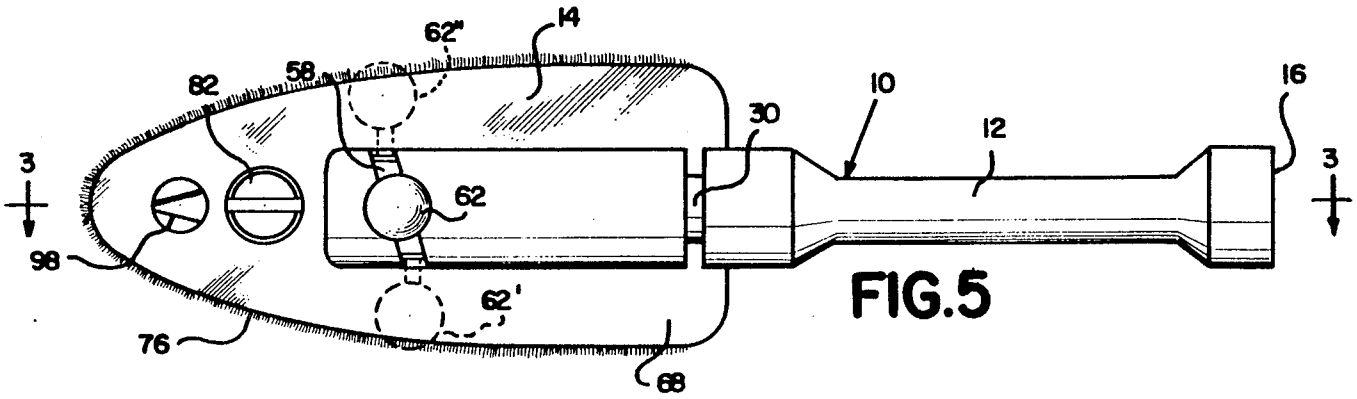
FIG. 5 is a top plan view of the brush of FIG. 1.

As shown in FIGS. 3 and 4, and as additionally illustrated in FIGS. 1, 2 and 5, the brush portion 14 is provided with an adjusting slot 58 which is angularly offset from the longitudinal axis of the brush to provide a camming action to adjust the axial position of the valve operating rod 46. An operating lever 60 extends from the slide block 52 and projects through the slot 58. The operating lever terminates exteriorly of the body 68 in a rounded knob 62. Referring FIGS. 2 and 5, when the knob 62 is pushed to the right as indicated by the arrowhead 64 to its rearward position as indicated by the dotted line representation 62', the operating lever 60 will be urged rearwardly as it travels through the camming adjusting slot 58 to thereby force the slide block 52 and the attached valve operating rod 46 rearwardly relative to the brush portion 14. The rearward movement of the valve operating rod 46 will cause the valve contacting end 48 to enter further into the valve chamber 46, past the plane of the flat seat 26 to impinge upon the flutter valve 28 and to force the flutter valve away from the seat 26. Under this condition, water can be made to flow continuously through the brush 10 for application upon a car or other surface (not shown).

When the operating lever 60 is oppositely moved by urging the lever 60 through the adjusting slot 58 in the direction indicated by the arrowhead 66, the thumb knob 62 will take the position indicated in phantom lines 62" (FIGS. 5 and 6) to thereby urge the operating lever 60 forwardly relative to the brush portion 14. In this position, the slide block 52 will be urged forwardly within the interior of the brush portion to thereby pull the valve operating rod 46 forwardly. When the slide block 52 is forwardly moved, the valve contacting end 48 will be caused to approach the plane of the flat valve seat 26, thereby allowing the flutter valve 28, under pressure from the impinging water (not shown) to more closely approach the seat. This will restrict flow through the valve to thereby control the volume of flow, without entirely shutting off the water flow.

Figure 6:
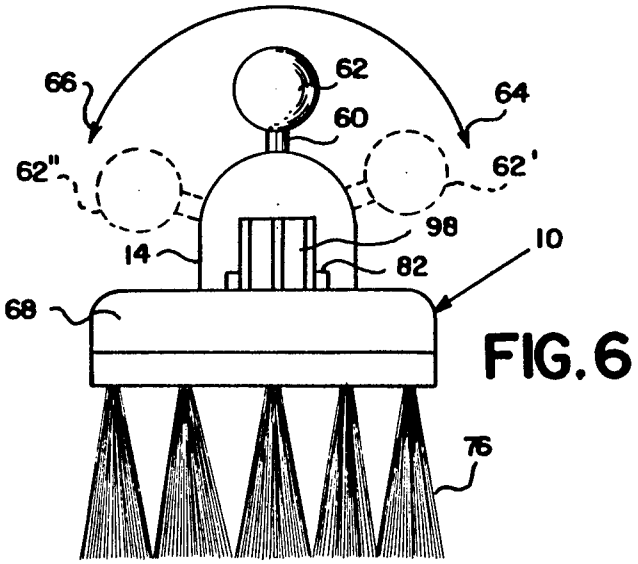
FIG. 6 is an end elevational view of the brush from the perspective of section line 6—6 on FIG. 2.

When the parts are medially positioned as indicated in full lines in FIGS. 3, 5 and 6, the geometry of the system is so designed that the handle portion 12 can pivot about the pivot pin 44 relative to the brush portion 14 to thereby pull the valve contacting end 48 forwardly of the plane of the valve seat 26. In this position, as previously mentioned, the flutter valve 28 will be pushed by the water pressure flush against the valve seat 26 to thereby positively close the valve and thereby shut off the flow of water through the brush 10. Only when the parts are pivoted about the pin 44, for example when the brush portion is applied against the surface to be cleaned, will the valve contacting end 48 push sufficiently against the flutter valve 28 to unseat the flutter valve and thereby permit water flow through the device.

Referring again to FIGS. 3 and 4, the body or brush portion 14 is formed with a generally planar, hollow body 68 which is provided with a discharge opening or nozzle 70 which is in fluid communication with the hollow conduit 32 of the brush portion 14. Accordingly, when the flutter valve 28 is upset or forced off of its seat 26, water will flow through the handle portion 12 as indicated by the arrow 22, through the conduit 32 as indicated by the arrow 72 and through the discharge opening 70 as indicated by the arrow 74 to directly impinge upon the surface to be cleaned. A plurality of bristles 76 are secured within the brush body 68 in well known manner to provide a conventional cleaning assembly in a manner to dislodge dirt and other extraneous material from the surface to be cleaned (not shown) in a conventional manner.

A hollow liquid soap or detergent receiving reservoir 78 is formed in the body 68 and is provided with a fill opening 80 to receive therein a conventional liquid soap or detergent (not shown) to aid in the cleaning process. A closure cap 82 which preferably includes a snap-type closure 84, or perhaps a threaded interengagement is provided to facilitate the loading and storage of a liquid cleaning agent within the detergent reservoir 78. An internal weir 86 subdivides the detergent reservoir 78 to the define a smaller soap discharge chamber 88. The weir 86 defines an upper soap passageway 90 between the top of the weir and the upper wall 92 of the brush body 68 so that by downwardly tilting the brush portion 14, liquid soap or detergent can be made to flow from the reservoir 78 into the soap discharge chamber 88.

As best seen in FIGS. 3 and 4, the soap discharge chamber 88 is provided with a gravity soap discharge opening 94 whereby any soap which is allowed to spill over into the soap discharge chamber 88 can flow by gravity through the discharge opening 94, through the bristles 76 for direct application upon the surface being cleaned. An eccentric flow control stopper 96 is connected to a knob 98 whereby when the knob 98 is turned in the direction of the arrow 100 (FIG. 2), the eccentric stopper 96 can be readily adjusted relative to the discharge opening 94 to partially or fully obstruct the opening, thereby allowing a wide latitude of liquid soap or detergent flow discharge through the discharge opening 94.

In use, a garden hose (not shown) should be connected to the threaded socket 16 in usual manner and water should be allowed to impinge upon the flutter valve 28. With the bristles 76 not in contact with any surface to be cleaned, the water under pressure will be sufficient to force the flutter valve 28 against the seat 26 in manner to contact the valve contacting end 48 of the operating rod 46. The water pressure will force the brush portion 14 and handle portion 12 to respectfully pivot about the pivot pin 44 relative to each other until the flutter valve 28 tightly seals upon the seat 26, thereby preventing water flow through the brush 10. In this condition, the handle portion 12 will be angularly cocked relative to the body or brush portion 14 in the manner illustrated in FIG. 3 and in broken lines in FIG. 2.

By contacting the surface to be cleaned with the bristles 76, the handle portion 12 and body or brush portion 14 will be pivoted about the pivot pin 44 to their aligned positions in the manner illustrated in FIG. 4 and in full lines in FIG. 2, thereby causing the valve contacting end 48 of the valve operating rod 46 to push against the flutter valve 28. This contact will force the flutter valve to leave its seat 26, whereby water will flow through the handle water conduit 20 as indicated by the arrow 22 (FIG. 4), through the valve chamber 24 as indicated by the arrow 102, through the nozzle bore 34 as indicated by the arrow 104, through the body portion conduit 32 as indicated by the arrow 72 and through the discharge opening or nozzle 70 as indicated by the arrow 74 for direct impingement upon the surface to be cleaned. To stop the flow of water, all that need be done is to remove the bristles 76 from contact with the surface being cleaned, whereby the water pressure will again force the flutter valve 28 against its seat 26. Continuous flow of water through the brush 10 can be achieved by urging the operating lever 60 to the right or rearwardly along the adjusting slot or groove 58 to a position whereby the valve contacting end 48 will always upset the flutter valve to thereby assure continuous water flow. See the broken line position 62' in FIGS. 5 and 6. To adjust the volume of flow, the operating lever 60 can be moved to the left as viewed in FIG. 6 in the direction of the arrow 66 until the thumb knob reaches the dotted line position 62" as indicated in broken lines in FIGS. 5 and 6.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims apended hereto.

What is claimed is:

1. A brush with automatic shut-off comprising:

a handle portion having a rearward end and a forward end, the handle portion being adapted to be connected to a source of water under pressure, the handle portion having a water conduit therethrough, the water conduit terminating at the forward end in a valve chamber, the valve chamber having a seat;

a nozzle projecting from the handle portion forwardly of the valve chamber and having a nozzle conduit therethrough adapted to communicate with said valve chamber;

a valve means positioned in the valve chamber to control water flow, the valve means being continuously biased toward the seat by the water under pressure;

the valve means being adapted to prevent the flow of water through the valve chamber when the valve means is in contact with the seat;

a body portion pivotally connected to the handle portion, the body portion being provided with a fluid conduit partially defined by a conduit body section to receive water flow through the valve chamber and a discharge nozzle to direct the flow of water outwardly of the brush;

operating means positioned within the body portion and being movable between forward and rearward positions to optionally contact the valve means dependent upon the pivotal position of said body portion with respect to said handle portion, the valve means being forced away from the seat when contacted by the operating means to cause water flow;

said nozzle including means for sealing that extends into and contacts said conduit body section, said means for sealing adapted to seal the water in the nozzle conduit and the fluid conduit in all pivotally moved positions of the body and handle portions; and, a plurality of bristles secured in the body portion to facilitate cleaning when the brush is in use.

2. The brush of claim 1 wherein the valve means is not connected within the valve chamber.

3. The brush of claim 2 wherein the valve means comprises a flutter valve.

4. The brush of claim 1 wherein a rearward section of the body portion and a forward section of the handle portion are pivotally interconnected.

5. The brush of claim 4 wherein the body portion and the handle portion are pivotally respectively movable between a first, axially aligned position wherein water is permitted to flow through the valve chamber and a second, non-axially aligned position wherein no water is permitted to flow through the valve chamber.

6. The brush of claim 5 wherein the valve means contacts the said seat when body and handle portions are moved to the second, non-axially aligned position.

7. The brush of claim 5 wherein the operating means contacts the valve means to force the valve means away from the seat when the body and handle portions are moved to the first, axially aligned position.

8. The brush of claim 7 wherein the operating means comprises a valve operating rod and means to move the valve operating rod relative to the body portion.

9. The brush of claim 8 wherein the means to move comprise a slide block in movable relationship within the body portion and wherein the valve operating rod is secured to the slide block.

10. The brush of claim 9 wherein the means to move comprises an operating lever extending from the slide block, the operating lever extending through the body portion fluid conduit and exteriorly of the body portion.

11. The brush of claim 10 wherein the body portion is provided with an adjusting slot and wherein the operating lever projects into and is movable within the adjusting slot.

12. The brush of claim 11 wherein the body portion has a longitudinal axis and wherein the adjusting slot is angularly oriented relative to the longitudinal axis.

13. The brush of claim 11 including a seal means in the slide block to prevent water from the body portion fluid conduit from reaching the adjusting slot.

14. The brush of claim 5 wherein the nozzle is positioned within the conduit body section.

15. The brush of claim 14 wherein the means for sealing is a peripheral seal on the nozzle, the peripheral seal peripherally contacting the conduit body section to prevent the escape of water between the nozzle and the conduit body section in all pivotally moved positions of the body and handle portions.

16. The brush of claim 1 and a detergent reservoir provided in the body portion above the bristles.

17. The brush of claim 16 wherein a weir subdivides the reservoir to define a detergent discharge chamber and a detergent storage chamber.

18. The brush of claim 17 wherein there is no discharge opening provided for the detergent storage chamber.

19. The brush of claim 17 wherein the detergent discharge chamber is provided with a discharge opening to permit detergent to exit the body portion.

20. The brush of claim 19 and a movable flow control stopper overfitting the discharge opening, the flow control stopper being adapted to be moved relative to the discharge opening to vary the quantity of flow through the discharge opening.

* * * * *